United States Patent [19]

Bishoff et al.

[11] 4,192,562

[45] Mar. 11, 1980

[54] INTERFITTING AND REMOVABLE MODULAR, FRAME, STORAGE UNITS

[76] Inventors: Mark L. Bishoff, 10331 Wilde Lake Ter., Columbia, Md. 21043; Theodore Bishoff, 4701 Willard Ave., Apt. #1022, Chevy Chase, Md. 20015

[21] Appl. No.: 935,966

[22] Filed: Aug. 22, 1978

[51] Int. Cl.[2] ..... A47B 87/00; A47B 47/00; A47B 88/04

[52] U.S. Cl. ..... 312/108; 211/189; 220/23.4; 220/23.6; 312/111; 312/198; 312/257 SK; 312/349

[58] Field of Search ..... 312/107, 108, 111, 257 SK, 312/263, 349, 257 A, 257 R, 264, 198, 140; 220/23.4, 23.6, 4 F; 108/111; 211/189, 182, 188; 217/12 R, 43 A

[56] References Cited

U.S. PATENT DOCUMENTS

| | | | |
|---|---|---|---|
| 3,491,896 | 1/1970 | Crary | 108/111 |
| 3,722,704 | 3/1973 | Piretti | 211/188 |
| 3,836,218 | 9/1974 | Hallal | 312/257 R |
| 3,851,936 | 12/1974 | Muller | 220/23.4 |
| 4,045,104 | 8/1977 | Peterson | 312/263 |

*Primary Examiner*—Alexander Grosz
*Attorney, Agent, or Firm*—Berman, Aisenberg & Platt

[57] ABSTRACT

A set of four longitudinal, four vertical and four cross bars are secured together to form a three dimensional open frame of a storage unit capable of being closed to a box-like structure by a plurality of flat panels. The longitudinal bars each have a longitudinal T-shaped rib and a T-shaped, longitudinal recess, capable of slideably receiving the rib of an adjacent frame so that a plurality of frames may be arranged and stacked to form a self sustaining structure from which one or more frames or storage units may be slideably removed without disturbance to the remaining structure and units.

20 Claims, 5 Drawing Figures

INTERFITTING AND REMOVABLE MODULAR, FRAME, STORAGE UNITS

BACKGROUND OF THE INVENTION

1. Field of the Invention

The invention relates to a rectangular box frame made of a set of bars which may be partially or completely closed by panels to form storage units, and in which certain of the bars of adjacent units slideably interfit to permit removal of the units from a stack or wall like structure.

2. The Prior Art

Modular cabinet assemblies are known in the art and include devices which consist of a plurality of rectangular cabinets formed of wood or plastic and open at the front. These are arranged stacked one upon another to form a wall for use as a decorative storage device, or room divider. Since the cabinets rest upon each other without interlocking; they cannot be used drawer fashion and intermediate cabinets cannot be removed without collapse of the upper cabinets in the wall.

Another cabinet assembly is revealed in U.S. Pat. No. 3,851,936 as comprising a plurality of wooden boxes open at the front and having four sides formed with external wedge-shaped tongues and grooves, the tongues of one box slideably interfitting the grooves of another box. In this construction the wedge shape given the tongues is meant to lock the cabinets from movement once attached to a support shelf or wall. The described construction is expensive and does not lend itself to multiple types of use.

Still another known construction involves the building of a frame of metal or wood about fibreboard tubes in a wall structure and inserting cardboard drawers into the tubes of the wall. These drawers, utilized as filing units, are individually removable, but they are not of attractive appearance. The frame being separate from the drawers adds greatly to the expense.

SUMMARY OF THE INVENTION

The present invention overcomes the defects and disadvantages of conventional modular storage units and wall structures as briefly outlined above, by providing a storage structure formed of inexpensive modular, three dimensional frames, each frame comprising a set of longitudinal, vertical and cross bars, the bars of each set being secured together to form a rectangular open frame of box-like shape which may be partially, or completely, closed by one or more flat panels. Each longitudinal bar is formed with a longitudinal rib and a longitudinal recess, the ribs of one box-like frame slideably fitting in the recesses of adjacent frames to form a self sustaining wall structure even though one, or more, internal frames, or storage units, are completely removed from the wall.

From the above it should be noted that a primary object of the invention is to provide modular storage units stackable into a wall structure, in which the framework of the wall and that of the individual storage units are one and the same.

Another important object of the invention is to provide slideable and interlocking ribs and recesses on the adjacent longitudinal frame bars of the storage units stacked as a wall structure, to enable drawer-like operation of the storage units and complete removal of some of the units without collapse of or disturbance to the remaining units of the wall structure.

Still another important object of the invention is to provide a frame-like storage unit construction in which one or more panels can be utilized to partially or completely enclose a frame and form a storage unit, thus varying a stacked wall of such units to include not only drawers, but partitions and shelves, and enabling the wall to function as an attractive decorative piece, room divider, or storage partition.

Yet another object of the invention is to provide a modular storage wall structure, having the above described characteristics, which is inexpensive to produce and easy to assemble and use, the common frame parts of both the storage units and wall structure being preferably formed of low cost plastic bars and the panels for partially or completely closing the storage units being formed of inexpensive fibreboard, or plastic panels or boxes.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of a specific embodiment, when read in connection with the accompanying drawings, wherein like reference characters indicate like parts throughout the several Figures, and in which:

DESCRIPTION OF THE PREFERRED EMBODIMENT

Figure 1:
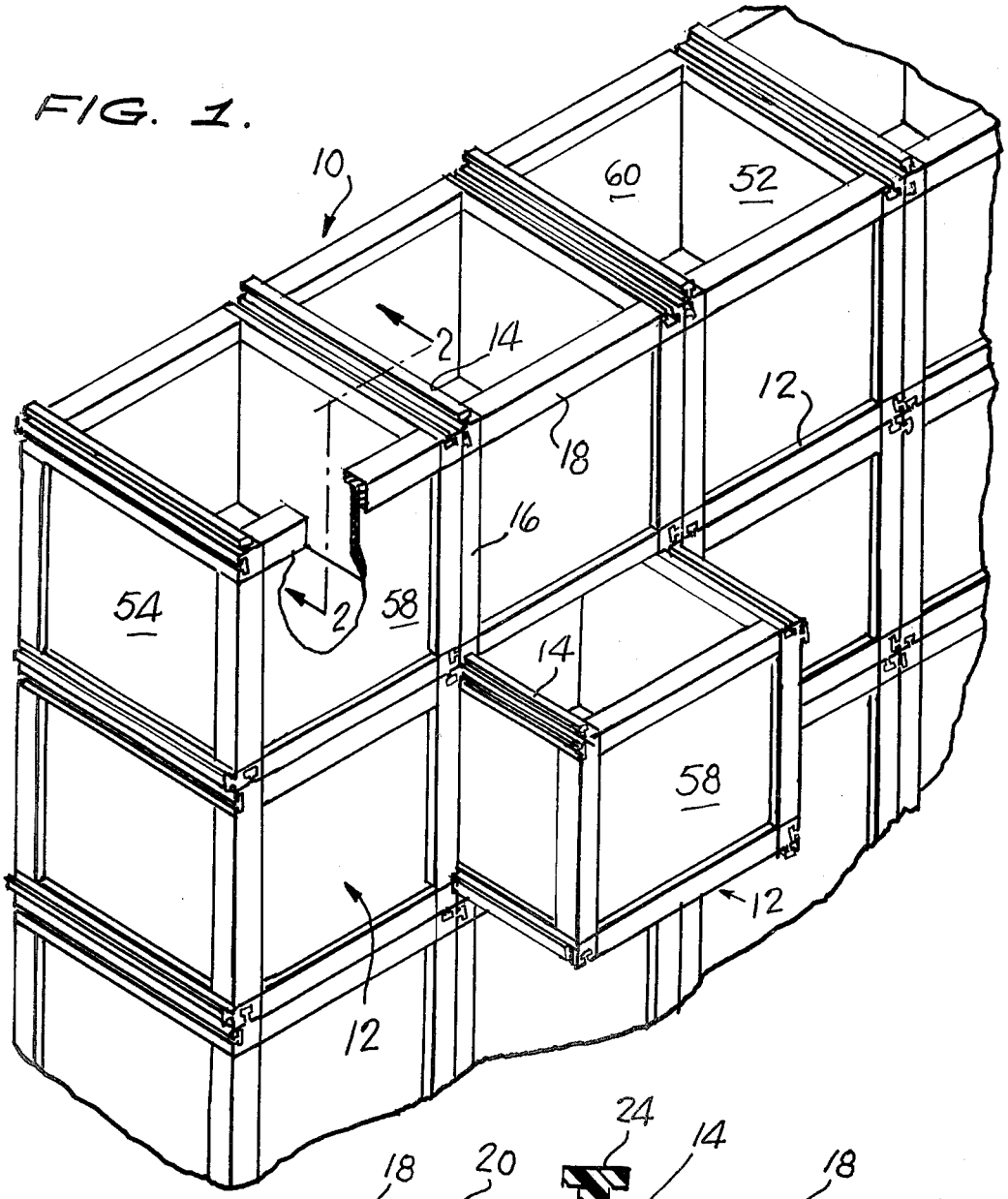
FIG. 1 is a perspective view illustrating a wall structure formed of modular, drawer-like storage units constructed in accordance with the invention.
Figure 2:
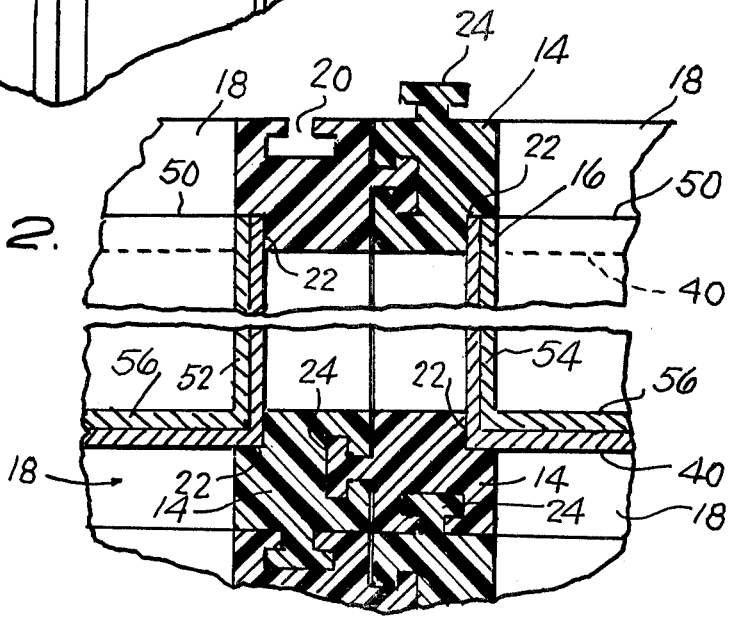
FIG. 2 is a sectional view of a portion of the wall taken along line 2—2 of FIG. 1, looking in the direction of the arrows.
Figure 3:
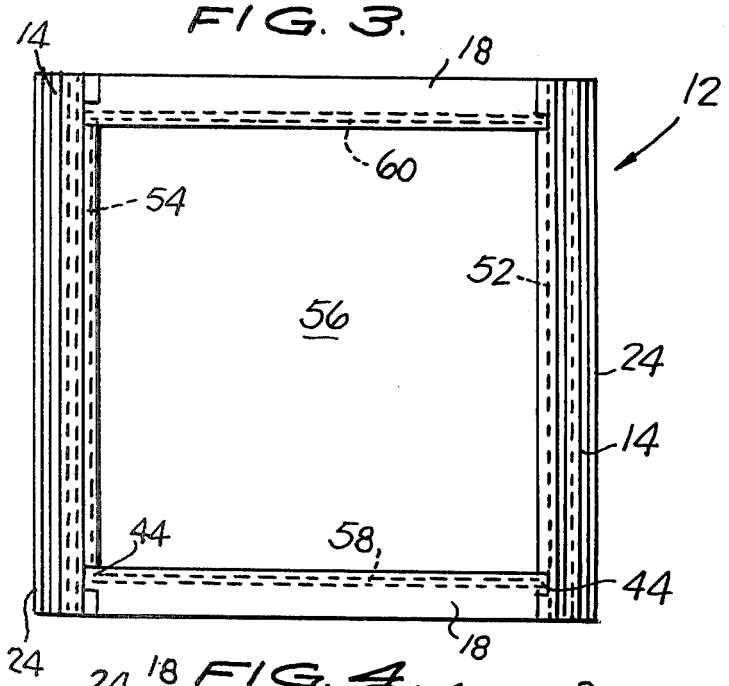
FIG. 3 is a plan view of one of the storage units removed from the wall.
Figure 4:
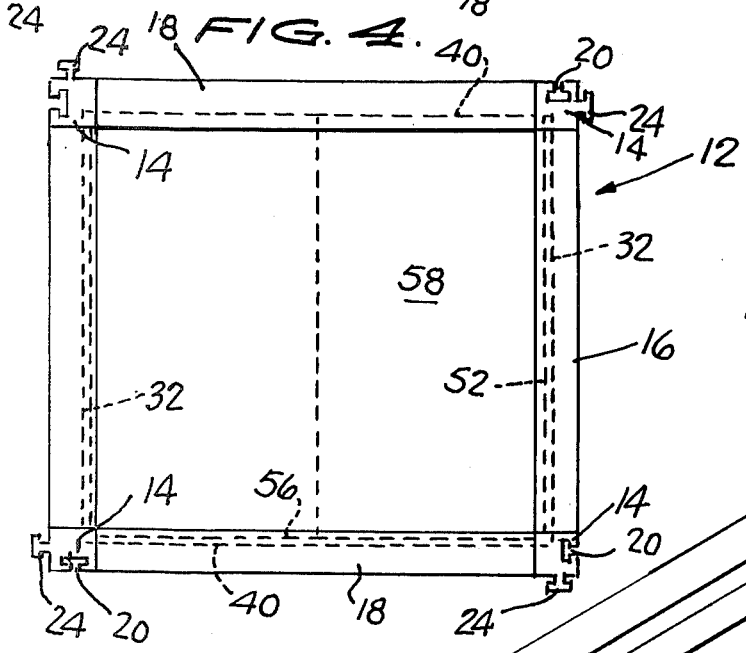
FIG. 4 is a front elevation of the storage unit of FIG. 3.
Figure 5:
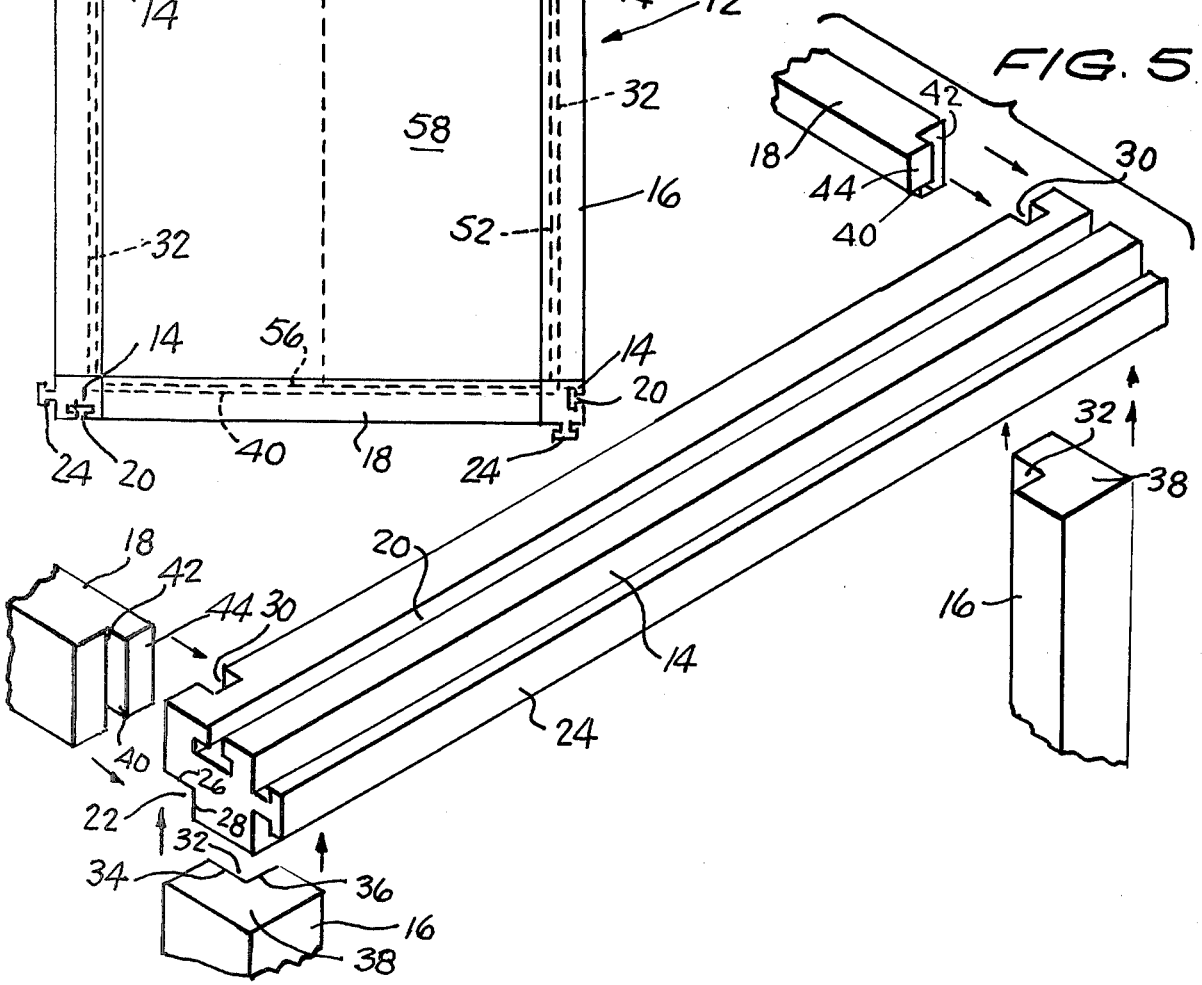
FIG. 5 is a fragmentary exploded view of a horizontal bar and associated vertical and cross bars showing the manner of assembly of the frame of a storage unit.

Referring more particularly to the drawings, FIGS. 1 and 2 illustrate a storage wall 10, exemplifying one preferred embodiment of the invention, formed of self sustaining, interfitted, drawer-like storage units 12. The construction of each unit 12 is best seen in FIGS. 2 through 4 while the manner of assembling each unit frame is most apparent from FIGS. 2 and 5.

Each storage unit 12 comprises a three dimensional frame formed of a set of four longitudinal bars 14, four vertical struts, or bars 16, and four cross bars 18, the twelve bars being assembled and connected to form a box-like frame. All of the twelve bars are preferably formed of an extruded plastic material, such as polystyrene, which is strong and attractive, but inexpensive. However, the bars obviously may be formed of metal, wood or other materials, including even fibreboard.

The four bars 14 of each set making up a storage unit 12 are identical in size and shape, and are assembled at the upper and lower edges of the unit frame to extend longitudinally from front to rear. Each bar 14 has a generally square cross section relieved by a recess 20 and notch 22 to be described and a longitudinal rib, or rail 24, protruding from one side. The rib 24 is preferably formed with a T-shaped cross section to provide interlocking support of adjacent frames, or storage units, but other cross sections may be used. The rib extends from end to end of the bar. The recess 20 is formed in a surface of bar 14 adjacent the surface from which the rib protrudes and has the same T-shaped cross section as the rib, but is of slightly larger size so as to be capable of slideably receiving a rib of an adjacent storage unit. Recess 20 also extends from end to end of the bar. The connecting edge for the remaining two sides of bar 14 is cut away by the notch 22, FIG. 5, extending from end to end of the bar and having perpendicular walls 26, 28 adapted to seat the panels for completely, or partially, closing the frame of the storage unit, as will appear more fully hereinafter. Close to the ends of the bar 14 is provided a pair of slots 30, 30 in the same surface as contains the notch 22, i.e., the surface opposite that having rib 24. The slots extend from the surface containing the recess 20 to the notch 22. Slots 30, 30 receive interfitting tongues 44 extending from the cross bars 18 to strengthen the frame of unit 12. As best seen in FIG. 4, the bars 14 having the same cross section, may occupy any one of the four edges of unit 12 by rotating a bar about its own longitudinal axis in 90° steps. Thus a bar when placed to form the upper right edge of the unit has rib 24 extending to the right. Were the same bar placed at the upper left edge and turned 90°, the rib 24 of the bar would extend upwardly. Similarly, the same bar placed at the bottom left edge and turned 90° would have rib 24 extending to the left, and when placed at the bottom right edge, the rib would extend downwardly. In this way, one rib 24 of each unit 12 interfits with a recess 20 of each of four adjacent units in a stack or wall of units. It should be noted that by turning the bar, or changing its cross section, the rails 24 may be faced in different directions, so that if, for example, it became important to have a flat bottom on the storage unit, two bars having recesses 20 may be used on the bottom and two bars having rails facing up may be used at the top. Other configurations are obviously possible.

Four vertical bars 16 form the four vertical corners of each storage unit at the front left and right, and rear left and right. Bars 16 have a constant square or rectangular cross section relieved at one corner by a longitudinal notch 32 extending from end to end of the bar. The sides 34, 36 of the notch are perpendicular to each other, and of the same length as sides 26, 28 of notch 22 in bars 14, so as to frame and seat the storage unit closing panels, or box, as will appear later. The upper and lower ends 38 of bars 16 are flat and adapted to be glued, cemented, or otherwise secured to the adjacent sides of longitudinal bars 14 so as to space the longitudinal bars apart vertically in the assembled unit. It will be noted that each of the four bars 16, all having but one size and cross sectional shape, is nevertheless adapted to be used at any vertical corner of unit 12 by rotating the bar in 90° steps about its own axis.

Four cross bars 18 form the upper and lower horizontal edges of each storage unit frame and space the bars 14 horizontally. Bars 18 have a uniform cross section of square or rectangular shape relieved at one corner by a notch 40, FIG. 5, whose sides are perpendicular to each other and match in length the sides 34, 36 of notches 32 in the vertical bars to seat the closure panels or box sides of the unit when assembled. The notch 40 extends from end to end of the cross bar. A vertical notch 42 is formed at each end of the bar 18 to leave a protruding tongue 44 which fits tightly in the slot 30 of the adjacent longitudinal bar 14. The sides of notches 42 and tongues 44 may be coated with a glue, or cement, to bond the cross bars and longitudinal bars together. The adjacent sides of bars 18 are also preferably secured to portions of the end surfaces 38 of vertical bars 16 by glue or cement. It should be noted that all four of the cross bars, although having but one size and cross sectional shape, are nevertheless adapted to be used at any of the four positions in the frame of unit 12 by turning the bars over end for end, or 180°, in steps so as to properly fit tongues 44 into slots 30 and align notch 40 with notches 22 and 32.

Each storage unit 12 is illustrated in FIGS. 1 and 2 as being closed by an open top box 50 having double ply, fibreboard side walls 52, 54, bottom wall 56 and front and rear walls 58, 60. The corners and upper and lower edges of box 50 are preferably glued or cemented to sides of notches 22, 32 and 40.

The storage units 12 may be factory assembled, or fabricated and sold to individuals as kits for home assembly. In the latter instance, each kit would constitute four longitudinal bars 14, four vertical bars 16, four cross bars 18 and a cardboard carton 50 in flat folded condition, or individual wall panels 52, 54, 56, 58 and 60.

To assemble a storage unit 12 it is merely necessary to appropriately place two longitudinal bars 14 with their ribs 24 extending to the left and downward respectively, and affix them to two cross bars 18 turned so that their notches 40 face upwardly and their glue coated tongues 44 pressed into slots 30 of the bars 14. The four vertical bars 16 are then placed at the corners with their notches 32 facing inwardly and their bottom edges 38 are glued to the assembled bars 14 and 18. The box 50 is then seated in the assembled parts of the frame and its edges glued to the sides of notches 22 and 32 and 40. The remaining two longitudinal bars 14 and two upper cross bars 18 are assembled together as described for the lower bars 14 and 18, taking care that the ribs 24 extend to the right at the top right and upwardly at the top left and that the notches 40 of the cross bars open downwardly and inwardly. The assembled four upper bars are then coated with glue in notches 22 and 40 and lowered about the upper edges of box 50 and glued to the upper surfaces 38 of vertical bars 16.

Any number of units 12 may be assembled in the manner described above and stacked to form a file storage wall such as that shown in FIG. 1. When thus stacked, with the ribs 24 slideably engaged in the recesses 20 of adjacent units, each unit may be slid forwardly or rearwardly in the manner of a drawer to provide access to the contents. Because of the interlocking of the ribs and recesses any one, several, or even all of the units in any vertical line can be completely removed to another location without toppling of the remaining units. This is important since it permits removal and return or replacement of storage units without the need for handling or rearranging the other remaining units.

In the illustrated wall structure, it should be apparent that many modifications are possible which would greatly enhance the uses and the value of the described modular construction. For example each unit may be provided with a cover panel if desired. Also the front panel may be formed with a hand opening, or a handle (not shown). It has been explained that instead of a box, individual panels may be utilized to form a partial, or complete enclosure. Thus the wall structure, as a room divider for example, may be constructed of any number of units 12 each consisting of an open framework constituted only by the twelve bars 14, 16 and 18. The storage wall may be varied by omitting all panels except bottom panels 56 in certain units to function as shelves. Some units may be formed to have only bottom panels 56 and side panels 52, the latter functioning as shelf dividers. Still other units may be formed with bottom, top, rear and side panels but open at the front to form storage cubes receiving display items or ornaments through their front openings. An infinite variety of storage functions and appearances is thus possible. While the set of bars 14, 16 and 18 can be formed of metal or wood, and the carton 50 or its individual panels of materials other than fibreboard such as plastic, it is preferred to use plastic bars and waxed, or pigment coated, fibreboard panels to provide a sufficiently strong structure of attractive appearance at minimum expense.

While the preferred and described embodiment utilizes identical bars 14, 16 and 18 of three types, it should be obvious that the shapes of an individual type may be varied. Their dimensions may also be varied so that the storage units and structure may be enlarged for warehousing applications as well as home or office applications. Instead of utilizing glue or cement to form a frame unit, the bars may be connected by other types of fasteners such as bolts, rods, rivets, spring and snap fasteners.

In an alternative construction, not illustrated, the plastic bars 14, 16 and 18 are replaced by fibreboard bars having the same size and configuration. The bars may be formed of multiple layers of fibreboard bonded together and bent, cut or molded to shape. Each layer of the bar may preferably be of three ply construction comprised of thin, flat upper and lower sheets of fibreboard, or fiberglass, and a core of honey comb or corrugated pattern, made of kraft paper impregnated with a phenolic resin. Such a construction would yield a very stiff, strong structure capable of withstanding for long periods of time the weight and strain placed on the storage units.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. A modular storage unit kit, comprising a set of four longitudinal, four vertical, and four cross bars, adapted to be secured together to form an open three dimensional frame, each of said longitudinal, vertical and cross bars of the set being formed with a notch extending from end to end along one edge of the bar, said notch having perpendicular sides adapted to seat and secure panels forming walls of the storage unit, said longitudinal bars each having longitudinal ribs and longitudinal recesses, the rib protruding from one side and the notch being formed in the opposite side, said recess being formed in a third side, the recesses of one frame being of a size and shape to slideably receive the ribs of adjacent frames so that a plurality of assembled frames may be fitted together with their ribs and recesses in interlocked fashion to form a self sustaining structure having slideable, removable units.

2. A modular storage unit kit according to claim 1 wherein each of said longitudinal bars has the same cross sectional configuration, whereby the same longitudinal bar may be used to form any one of the longitudinal edges of the frame by turning the bar in 90° steps about its longitudinal axis.

3. A modular storage unit kit according to claim 1, wherein said ribs and recesses have uniform T-shaped cross sections.

4. A modular storage unit kit according to claim 1, wherein each of said longitudinal bars is provided with a vertical slot near each end, and each of said cross bars is formed with a tongue protruding from each end, said tongues fitting in said slots to hold the cross bars to the longitudinal bars.

5. A modular storage unit kit according to claim 4, wherein said vertical slots are formed in the same wall of the longitudinal bar as said notch.

6. A modular storage kit according to claim 1, wherein said longitudinal, vertical and cross bars are formed of plastic material.

7. A modular storage frame unit, comprising four longitudinal, four vertical and four cross bars secured together to form an open three dimensional frame unit, each of the longitudinal, vertical and cross bars being formed with a notch extending from end to end along one edge of the bar, said notch having perpendicular sides adapted to seat and secure panels defining walls of a storage unit, said longitudinal bars each having longitudinal ribs and longitudinal recesses, the rib protruding from one side and the notch being formed in the opposite side, said recess being formed in a third side, the recesses of one unit being of a size and shape to slideably receive the ribs of adjacent units, so that a plurality of units may be fitted together with their ribs and recesses in interlocked fashion to form a self sustaining structure having slideable, removable frame units.

8. A modular storage frame unit according to claim 7, wherein each of said longitudinal bars has the same cross sectional configuration, whereby the same longitudinal bar may be used to form any one of the longitudinal edges of the frame unit by turning the bar in 90° steps about its own longitudinal axis.

9. A modular storage frame unit according to claim 7, wherein said ribs and recesses have uniform T-shaped cross sections.

10. A modular storage frame unit according to claim 7, wherein each of said longitudinal bars is provided with a vertical slot near each end, and each of said cross bars is formed with a tongue protruding from each end, said tongue fitting in said slots to hold the cross bars to the longitudinal bars.

11. A modular storage frame unit according to claim 9, wherein said vertical slots are formed in the same wall of the longitudinal bar as said notch.

12. A modular storage frame unit according to claim 7, wherein said longitudinal, vertical and cross bars are formed of plastic material.

13. A modular storage frame unit according to claim 7, wherein at least one panel is fitted into said frame unit to form a wall of a storage unit.

14. A self sustaining frame structure of slideably removable, three dimensional frame storage units, comprising a plurality of storage units interfitted with one another, each unit being formed of a set of longitudinal, vertical and cross bars secured together to form an open, three dimensional frame adapted to receive and hold one or more panels defining walls of a storage unit, said longitudinal bars having longitudinal protruding ribs and longitudinal recesses, said recesses of one frame slideably receiving the ribs of adjacent frames to hold the frames in interlocked fashion while permitting the frames to be individually slid partially out of the structure and removed from the structure without disturbance to and without collapse of the remaining frames.

15. A self sustaining frame structure according to claim 13, wherein said ribs and recesses have uniform T-shaped cross sections.

16. A self sustaining frame structure according to claim 13, wherein each of said longitudinal, vertical and cross bars of said set is formed with a notch extending from end to end along one edge of the bar, said notch having perpendicular sides adapted to seat and secure panels forming walls of the storage unit.

17. A self sustaining frame structure according to claim 15, wherein each of said longitudinal bars has the same cross sectional configuration, the rib protruding from one side and the notch being formed in the opposite side, said recess being formed in a third side, whereby the same longitudinal bar may be used to form any one of the longitudinal edges of the frame by turning the bar in 90° steps about its own longitudinal axis.

18. A self sustaining frame structure according to claim 15, wherein each of said longitudinal bars is provided with a vertical slot near each end, and each of said cross bars is formed with a tongue protruding from each end, said tongue fitting in said slots to hold the cross bars to the longitudinal bars.

19. A self sustaining frame structure according to claim 17, wherein said vertical slots are formed in the same wall of the longitudinal bar as said notch.

20. A self sustaining frame structure according to claim 13, wherein said longitudinal, vertical and cross bars are formed of plastic material.

* * * * *

UNITED STATES PATENT AND TRADEMARK OFFICE

CERTIFICATE OF CORRECTION

PATENT NO. : 4,192,562

DATED : March 11, 1980

INVENTOR(S) : Mark L. Bishoff; Theodore Bishoff.

It is certified that error appears in the above-identified patent and that said Letters Patent are hereby corrected as shown below:

Column 6, line 54, delete "9" and insert --10--.

Column 7, line 9, delete "13" and insert --14--.

Column 7, line 12, delete "13" and insert --14--.

Column 7, line 18, delete "15" and insert --16--.

Column 8, line 7, delete "15" and insert --16--.

Column 8, line 14, delete "17" and insert --18--.

Column 8, line 17, delete "13" and insert --14--.

Signed and Sealed this

*Tenth* Day of *June 1980*

[SEAL]

*Attest:*

SIDNEY A. DIAMOND

*Attesting Officer*

*Commissioner of Patents and Trademarks*